US007066461B2

(12) United States Patent
Asada

(10) Patent No.: US 7,066,461 B2
(45) Date of Patent: Jun. 27, 2006

(54) PAPER SEPARATION MECHANISM AND PAPER FEED APPARATUS WITH THE PAPER SEPARATION MECHANISM

(75) Inventor: Tetsuo Asada, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 63 days.

(21) Appl. No.: 10/670,333

(22) Filed: Sep. 26, 2003

(65) Prior Publication Data

US 2004/0084831 A1 May 6, 2004

(30) Foreign Application Priority Data

Oct. 31, 2002 (JP) ..... 2002-318439

(51) Int. Cl.
*B65H 3/52* (2006.01)

(52) U.S. Cl. ..... 271/121; 271/167; 347/104

(58) Field of Classification Search ..... 271/162, 271/137, 104, 167, 124, 121, 149, 276, 196, 271/197; 347/104; 400/579, 582; 101/419, 101/448

See application file for complete search history.

(56) References Cited

U.S. PATENT DOCUMENTS

| | | | | |
|---|---|---|---|---|
| 4,606,535 | A * | 8/1986 | Larson | 271/10.03 |
| 4,887,806 | A * | 12/1989 | Tanaka et al. | 271/121 |
| 5,573,338 | A * | 11/1996 | Morikawa et al. | 400/611 |
| 5,697,604 | A * | 12/1997 | Tanaka | 271/121 |
| 5,857,671 | A * | 1/1999 | Kato et al. | 271/10.11 |
| 5,879,003 | A | 3/1999 | Kovach et al. | |
| 5,895,040 | A * | 4/1999 | Oleksa et al. | 271/124 |
| 5,938,355 | A * | 8/1999 | Suzuki | 400/624 |
| 6,010,126 | A * | 1/2000 | Mou et al. | 271/121 |
| 6,095,515 | A * | 8/2000 | Kiyohara et al. | 271/161 |
| 6,398,205 | B1 * | 6/2002 | Nakamura et al. | 271/18 |
| 6,536,757 | B1 * | 3/2003 | Chang | 271/16 |
| 6,585,250 | B1 * | 7/2003 | Hsiao | 271/121 |
| 6,616,138 | B1 * | 9/2003 | Tanaka | 271/124 |
| 6,942,209 | B1 * | 9/2005 | Kawakami | 271/121 |

FOREIGN PATENT DOCUMENTS

| | | | |
|---|---|---|---|
| JP | 5-24694 | * | 2/1993 |
| JP | A 7-251955 | | 10/1995 |
| JP | A-2002-137838 | | 5/2002 |
| JP | A 2002-137838 | | 5/2002 |

* cited by examiner

*Primary Examiner*—Kathy Matecki
*Assistant Examiner*—Thomas Morrison
(74) *Attorney, Agent, or Firm*—Oliff & Berridge, PLC

(57) ABSTRACT

A paper separation mechanism that requires no complicated design or manufacturing and prevents feeding of a plurality of sheets of paper simultaneously to assure sheet-by-sheet feeding of paper, and a paper feed apparatus using such a paper separation mechanism. In the paper feed apparatus, paper is fed sheet by sheet by cooperation of a paper feed roller and the paper separation mechanism which is abutted by the lower end of the paper stacked in an inclined state. The paper separation mechanism is provided with a plurality of projections which are abutted by the lower end of the paper and a plurality of arm portions holding the projections, respectively. Since each projection is not affected by the neighboring projection, load imposed by the paper on the each projection can be controlled independently by the corresponding arm portion.

27 Claims, 17 Drawing Sheets

PAPER SEPARATION MECHANISM AND PAPER FEED APPARATUS WITH THE PAPER SEPARATION MECHANISM

BACKGROUND OF THE INVENTION i) Field of the Invention

The present invention relates to a paper separation mechanism for separating and feeding a plurality of sheets of paper stored in a paper storage sheet by sheet by cooperating with a paper feed mechanism having a feed roller, and to a paper feed apparatus having the paper separation mechanism.

ii) Description of the Prior Art

In a conventional paper feed apparatus as shown in FIGS. 16A and 16B, for example, a paper separation unit 92 is disposed such that the lower end surface of paper 90 abuts the paper separation unit 92. Friction between the paper separation unit 92 and the lower end surface of the paper 90 causes only the uppermost sheet of paper to be separated (cf. Publication of Unexamined Japanese Patent Application No. 2002-137838).

In the conventional paper feed apparatus, a separation unit retainer 93 retains the paper separation unit 92 by two retaining portions 93*a* and 93*b* protruding upwardly and being arranged along the longitudinal direction of the separation unit retainer 93. A clearance 93*c* is formed between the paper separation unit 92 and the separation unit retainer 93 so as to provide flexibility to the paper separation unit 92.

The paper separation unit 92 made of rubber material such as polyurethane has a convex end surface configuration that corresponds approximately to the end surface configuration of a holder 91 disposed over the paper separation unit 92. As shown in FIGS. 17A to 17C, the paper separation unit 92 is provided with a protruding portion 92*a*, which is designed to always protrude from through an elongated hole formed in the metal holder 91 so as to extend in the stacking direction of paper. The height of the protruding portion 92*a* is such that a predetermined amount protrudes from through the elongated hole of the holder 91. The lower ends of the plurality of sheets of paper 90 stored in a paper storage abut the upper surface of the protruding portion 92*a*.

The upper surface of the protruding portion 92*a* is provided with small concavities and convexities 92*b*. The small concavities and convexities 92*b* is designed to increase the friction to occur between the lower ends of the plurality of sheets of paper 90 and the protruding portion 92*a*.

In the conventional apparatus, as described above, the paper 90 is separated sheet by sheet by the friction of rubber material and an operation to increase the friction by the small concavities and convexities 92*b*, based on the balance with the feeding power of a feed roller.

In the above conventional apparatus, however, the load of the paper is carried by the entire protruding portion of the paper separation unit. This results in a problem that determination of the bending of the paper separation unit as well as design and manufacturing of the small concavities and convexities to be provided on the protruding portion are complicated, since the load imposed on the protruding portion changes substantially depending on the number of sheets of paper providing the load on the paper separation unit.

There is also another problem that the amount of protrusion of the protruding portion 92*a* of the paper separation unit 92 from the holder 91, which is determined depending on the elasticity of the paper separation unit 92 made of rubber material, constantly changes depending on conditions such as temperature and humidity, and is therefore highly unstable.

The present invention has been made in view of these problems, and it is an object thereof to provide a paper separation mechanism that assures sheet-by-sheet feeding of paper by preventing feeding of a plurality of sheets of paper simultaneously and requires no complicated design or manufacturing, as well as a paper feed apparatus using such a paper separation mechanism.

SUMMARY OF THE INVENTION

The above and other objects are achieved by a paper feed apparatus according to the present invention which is provided with a paper storage capable of storing a plurality of sheets of paper, a paper feed mechanism having a paper feed roller for separating the paper stored in the paper storage sheet by sheet and capable of feeding the separated paper to a given convey path, and an inclined surface provided in the given convey path such that the inclined surface makes an obtuse angle relative to the paper stored in the paper storage. The paper feed apparatus comprises a plurality of projections capable of engaging with an end of the paper and of projecting from the inclined surface; and a plurality of resilient arm portions for holding the respective projections at respective positions allowing the respective projections to project from the inclined surface.

Since the plurality of projections are held by the plurality of arm portions, the loads imposed on the projections are shared and carried by the plurality of arm portions. Accordingly, it is possible to control the load imposed by the paper with respect to each of the plurality of projections held by the plurality of arm portions. Therefore, stable separation of paper can be achieved without any complicated design or manufacturing of the projections, and feeding of a plurality of sheets of paper simultaneously is prevented.

During paper feed, friction between the paper to be fed and the projections produces paper powder. However, most paper powder falls through the gaps between the arm portions according to the present invention, possible influence by the produced paper powder on paper separation may be reduced.

In the paper feed apparatus of the present invention, the arm portions are subjected to loads repeatedly imposed by the paper due to the structural feature. Accordingly, the arm portions are preferably made of metal, which will improve the durability of the paper feed apparatus.

While the loads by the paper are carried by the arm portions, the projections are actually abutted by the paper. Accordingly, the projections are preferably formed of a material having a high abrasion resistance.

This allows the abrasion of the projections due to the friction with paper to be reduced, which will improve the durability of the paper feed apparatus.

The projections are preferably arranged along the conveying direction of the paper to be fed. This enables the projections to hold the paper at a position in which the loads imposed by the paper may be appropriately maintained, and thus stable paper separation is achieved.

Although the projections may be formed as separate components from the arm portions, the projections are preferably formed integrally with the arm portions, so that the projections will never come off the arm portions. Also, integrating a plurality of components into a single component may usually reduce the manufacturing cost.

In the paper feed apparatus of the present invention, the arm portions are designed to be bent in accordance with the loads imposed by the paper on the respective projections. It is, therefore, preferable to lengthen the length of the arm portion by employing a bent configuration of the arm portion. With the lengthened arm portion, the amount of bending of the arm portion can be increased. Then, the amount of bending of the arm portion may be controlled in accordance with a small change of the load imposed by the paper.

The above-mentioned "bent configuration" includes a configuration of the arm portion with a combination of curved lines and/or linear lines, i.e. a configuration with curved lines, a combination of a curved line and a linear line, or a combination of linear lines, as long as the arm portion is in a bent configuration to lengthen the arm portion.

To control the amount of bending of the arm portion more strictly, it is preferable to form an elongated hole with its longitudinal direction along the conveying direction of the paper in the inclined surface such that the plurality of projections may project from the inclined surface through the elongated hole. This prevents the loads of the paper from being imposed directly on the arm portions, and facilitates control of the amount of bending of the arm portions and of the displacement amount of the projections. Thus, feeding of a plurality of sheets of the paper simultaneously is prevented effectively.

The arm portion may be held in a cantilever manner or at the both ends thereof. When the arm portion is held in a cantilever manner, the same operation as in a lengthened arm portion can be obtained. That is, the amount of bending of the arm portion may be increased, and may be controlled in accordance with a small change of the load imposed by the paper. When, the arm portion is held at the both ends thereof, left or right tilting of the projection relative to the paper feed direction may be reduced. Thus, feeding of a plurality of sheets of the paper simultaneously is prevented and stable paper feed can be achieved.

To prevent feeding of a plurality of sheets of the paper simultaneously, a plurality of projection need to be held by a plurality of arm portions. It is more preferable that each arm portion holds a plurality of projections or that each arm portion holds each projection independently. When each arm portion holds a plurality of projections, the load of the paper can be controlled with respect to each of the plurality of projections, and thus feeding of a plurality of sheets of the paper simultaneously is prevented and stable paper feed can be achieved. When each arm portion holds each projection independently, the load of the paper can be independently controlled with respect to each arm portion. Therefore, more stable paper separation can be achieved, and feeding of a plurality of sheets of the paper simultaneously is surely prevented.

To enhance paper separation effect, it is preferable that the paper storage holds a plurality of sheets of paper in an inclined state relative to the horizontal plane. This reduces the load imposed by the uppermost sheet of paper on the second uppermost sheet of paper, and thus facilitates enhanced paper separation.

In another aspect of the present invention, there is provided a paper separation mechanism for use in a paper feed apparatus provided with a paper feed roller for separating a plurality of stacked sheets of paper and feeding the paper sheet by sheet. The paper separation mechanism comprises a paper separation unit including: a plurality of projections capable of engaging with ends of the plurality of stacked sheets of paper in the paper feed direction; a plurality of resilient arm portions for holding the respective projections at respective positions allowing the respective projections to engage with the ends of the paper; and a base portion for holding the resilient arm portions.

Since the plurality of projections are held by the plurality of arm portions, the loads imposed on the respective projections are shared and carried by the plurality of arm portions. Accordingly, it is possible to control the load imposed by the paper with respect to each of the plurality of projections held by the plurality of arm portions. Therefore, stable separation of paper can be achieved without any complicated design or manufacturing of the projections, and feeding of a plurality of sheets of paper simultaneously is prevented.

During paper feed, friction between the paper to be fed and the projections produces paper powder. However, most paper powder falls through the gaps between the arm portions according to the present invention, possible influence by the produced paper powder on paper separation may be reduced.

To facilitate enhanced paper separation, the paper separation mechanism further comprises a holder unit having an elongated hole formed along the paper feed direction of the paper, wherein the projections of the paper separation unit project upward a predetermined length from through the elongated hole of the holder unit. This prevents the loads of the paper from being imposed directly on the arm portions, and facilitates control of the amount of bending of the arm portions and of the displacement amount of the projections.

To achieve further stable paper separation, it is preferable that at least the friction coefficient of the surface of the holder unit which abuts the end of the paper is lower than the friction coefficient between the sheets of paper. This reduces the resistance during paper feed, which achieves further stable paper feed by optimumly setting the projection amount of the projections and the abutting angle between the projection and the paper.

The paper separation mechanism preferably further comprises a separation unit retainer for retaining the base portion from thereunder so as to be sandwiched between the separation unit retainer and the holder unit. With the separation unit retainer, the base portion is securely retained and the resilience against the paper is increased, and thus an increased stability of paper separation can be achieved.

In the paper separation mechanism, the projection may be held at the center of the arm portion, and the arm portion may be held at the both ends thereof by the base portion. Alternatively, the arm portion may be held in a cantilever manner by the base portion. When the projection is held at the center of the arm portion, and the arm portion is held at the both ends thereof by the base portion, tilting of the projection is prevented, and thus, an increased stability of paper separation can be achieved. When the arm portion is held in a cantilever manner, the same operation as in a lengthened arm portion can be obtained. That is, the amount of bending of the arm portion may be increased, and may be controlled in accordance with a small change of the load imposed by the paper.

In the paper separation mechanism, the paper separation unit may be constituted by stacking a plurality of paper separation plates such that the arm portions and the projections alternate with each other, respectively. By this, the distance between neighboring projections can be reduced. This results in reduction of the loads imposed by the paper on the respective projections, so that stable paper feed without feeding a plurality of sheets of paper simultaneously can be achieved. Reduction of the loads imposed by the paper also may reduce damage on the paper caused by the friction between the paper and the projections.

To prevent feeding of a plurality of sheets of the paper simultaneously in the paper separation mechanism, a plurality of projections need to be held by a plurality of arm portions. It is more preferable that each arm portion holds a plurality of projections or that each arm portion holds each projection independently. When each arm portion holds a plurality of projections, the load of the paper can be controlled with respect to each of the plurality of projections, and thus feeding of a plurality of sheets of the paper simultaneously is prevented and stable paper feed can be achieved. When each arm portion holds each projection independently, the load of the paper can be independently controlled with respect to each arm portion. Therefore, more stable paper separation can be achieved, and feeding of a plurality of sheets of the paper simultaneously is surely prevented.

To improve the durability of a paper feed apparatus, the paper separation mechanism is preferably made of metal. With the paper separation mechanism made of metal, which has a better abrasion resistance compared with the paper separation mechanism made of rubber, the durability of a paper feed apparatus may be improved.

In a further aspect of the present invention, there is provided a paper feed apparatus which comprises: a paper storage capable of storing a plurality of sheets of paper; a paper feed mechanism having a paper feed roller for separating the paper stored in the paper storage sheet by sheet and capable of feeding the separated paper to a given convey path; and an inclined surface provided in the given convey path such that the inclined surface makes an obtuse angle relative to the paper stored in the paper storage. In the paper feed apparatus, the paper separation mechanism described above is preferably provided on the inclined surface. The paper separation mechanism, which is constituted as a component separate from the inclined surface and is disposed on the inclined surface, can be easily detached to facilitate maintenance such as adjustment of the angle of the projections and component replacement.

To enhance paper separation in the paper feed apparatus, it is preferable that the paper storage holds a plurality of sheets of paper in an inclined state relative to the horizontal plane. This reduces the load imposed by the uppermost sheet of paper on the second uppermost sheet of paper, and thus facilitates enhanced paper separation.

To further secure paper separation in the paper feed apparatus, it is preferable that two or more paper separation mechanisms are provided on the inclined surface. With a plurality of paper separation mechanisms provided in parallel, paper separation can be performed simultaneously by the plurality of paper separation mechanisms, which may facilitate further secure paper separation.

BRIEF DESCRIPTION OF THE DRAWINGS

Preferred embodiments according to the present invention will now be described with reference to the drawings in which.

DETAILED DESCRIPTION OF PREFERRED EMBODIMENTS

[Structure of the Paper Feed Apparatus]

Figure 1:
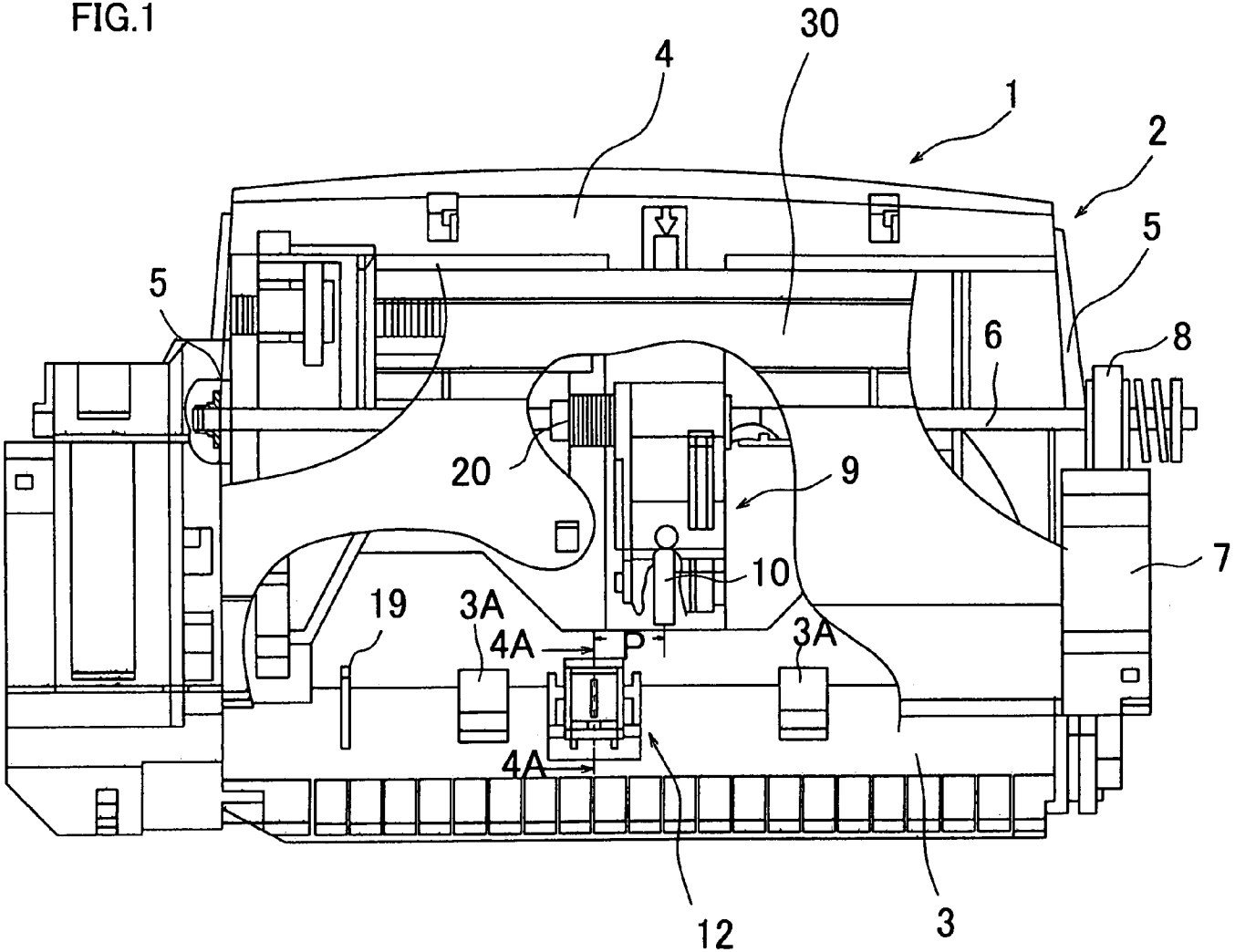
FIG. 1 is a partially broken front view showing the inside of a paper feed apparatus according to an embodiment.
Figure 2:
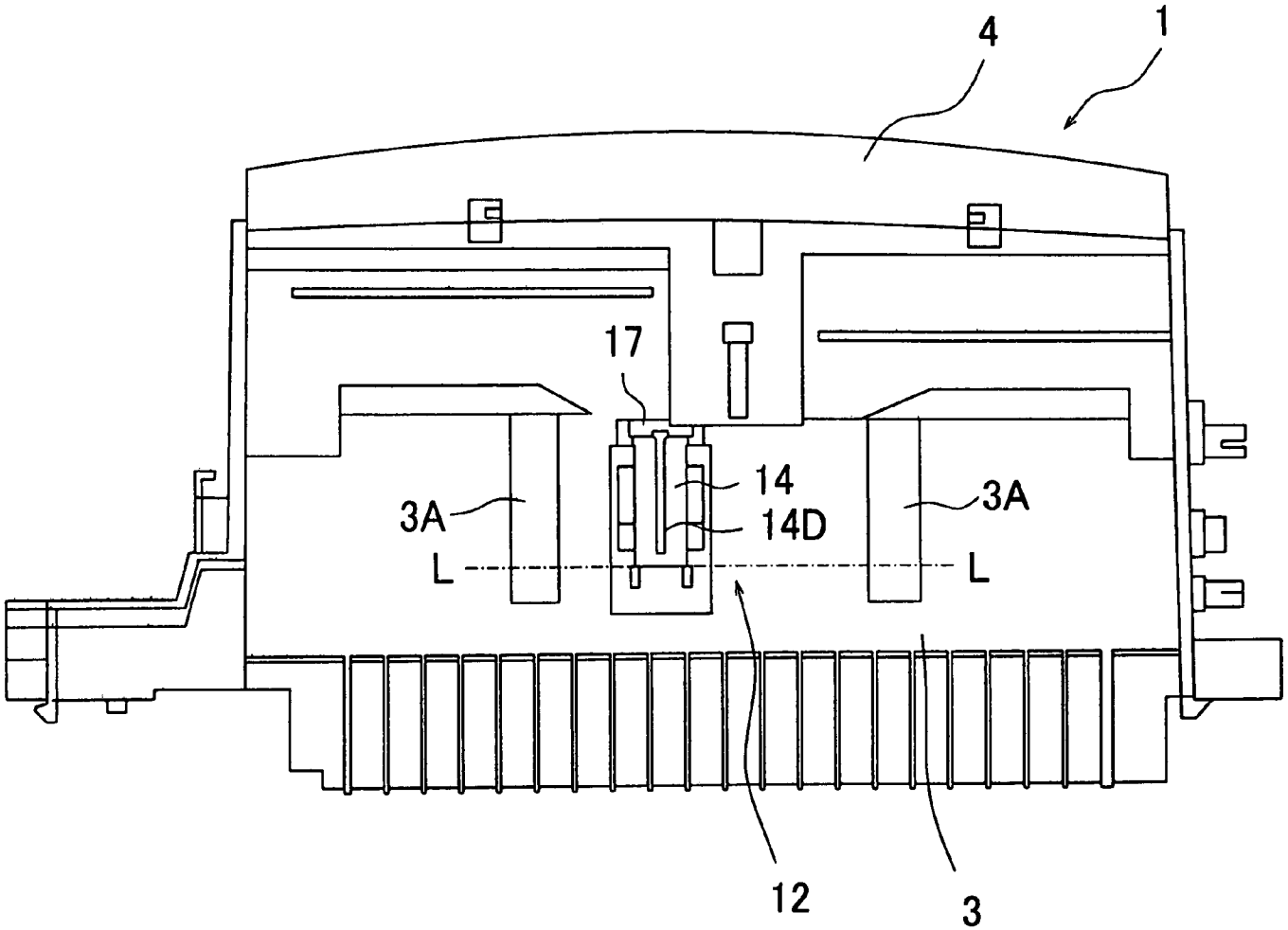
FIG. 2 is a plan view showing the inclined wall and the bottom wall of the paper feed apparatus.

The overall structure of a paper feed apparatus according to the present invention will now be described with reference to FIG. 1 and FIG. 2. FIG. 1 is a partially broken front view showing the inside of a paper feed apparatus 1 by partially breaking a cover 30, while FIG. 2 is a plan view showing only an inclined wall 4, a bottom wall 3 and portions associated with the bottom wall 3 by omitting a paper feed mechanism of the paper feed apparatus 1.

The paper feed apparatus 1 has a main housing 2 provided with the bottom wall 3 and the inclined wall 4 forming an obtuse angle with the bottom wall 3. The bottom wall 3 and the inclined wall 4 constitute a paper storage for storing paper in a stacked state. When paper is stored in a stacked state, the lower end of the paper abuts a paper sliding portion 3A provided on the bottom wall 3, a paper separation mechanism 12 which is disposed on the bottom wall 3 at a slightly left shifted position from the center of a paper feed roller 10, and a guide lib 19 which is gradually declined toward the downstream of the moving direction of the paper, while the reverse surface of the paper is held by the inclined wall 4. A cover 30 is disposed at a position a predetermined distance away from the inclined wall 4.

A paper feed roller shaft 6 is laid between a pair of side walls 5 formed on both sides of the main housing 2. A roller gear 8 to be engaged with a drive mechanism 7 fixed to the side wall 5 is fastened to one end (right end in FIG. 1) of the paper feed roller shaft 6, and a roller support 9 is rotatably mounted at the approximate center of the paper feed roller shaft 6.

Within the roller support 9, a train of gears (not shown) for conveying rotation of the paper feed roller shaft 6 are disposed and the paper feed roller 10 rotating through the train of gears is rotatably held. The roller support 9 is pressed against the paper with a prescribed pressure through a bias spring 20.

To feed the uppermost sheet of the paper stored in a stacked state between the bottom wall 3 and the inclined wall 4, the paper feed roller shaft 6 is first rotationally driven by the drive mechanism 7 through the roller gear 8. Then, the train of gears in the roller support 9 are driven, and thereby the paper feed roller 10 is rotationally driven. As a result, the paper is fed toward the downstream direction of the main housing 2.

Figure 3A:
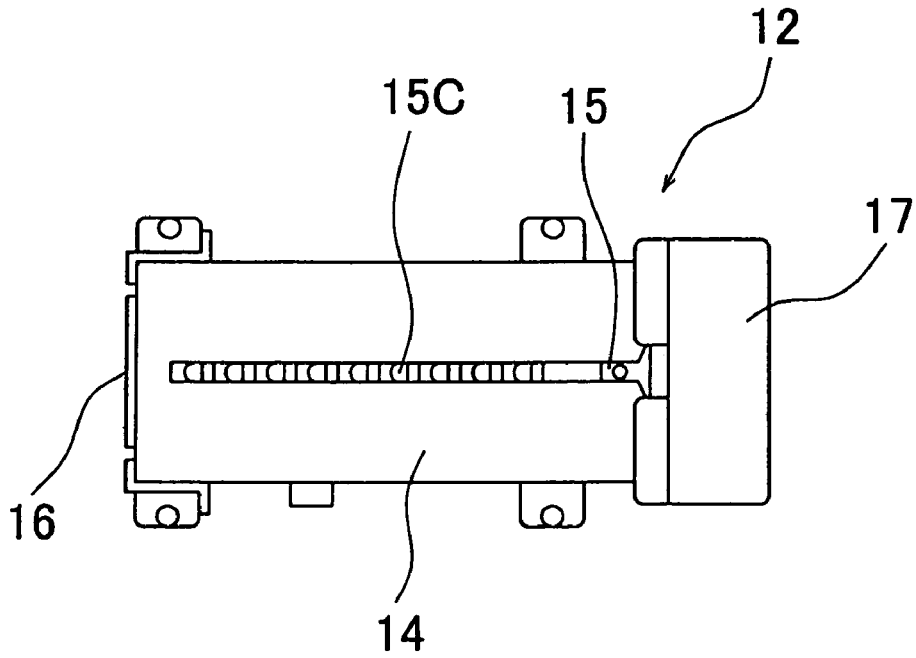
FIGS. 3A and 3B are views showing the structure of a paper separation mechanism.
Figure 3B:
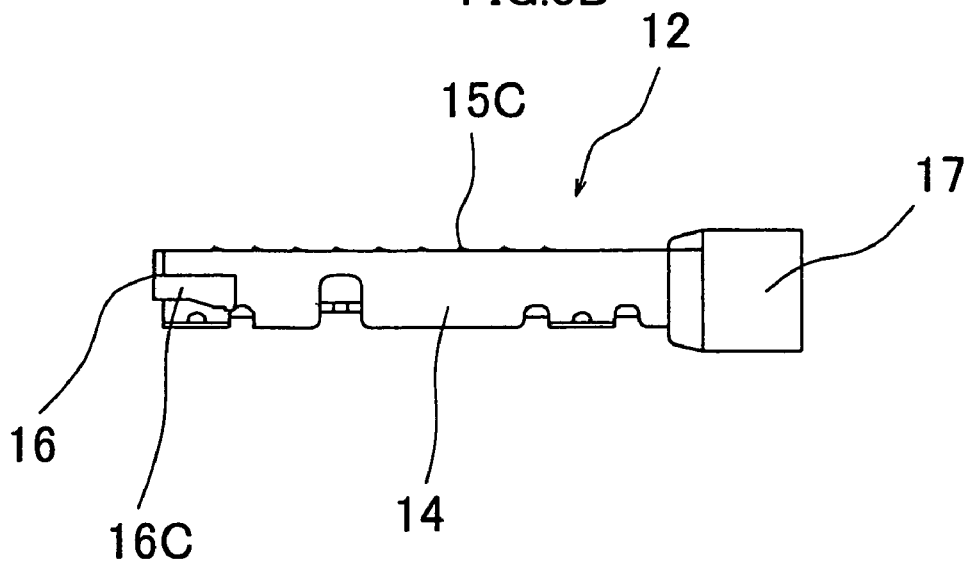
Figure 4A:
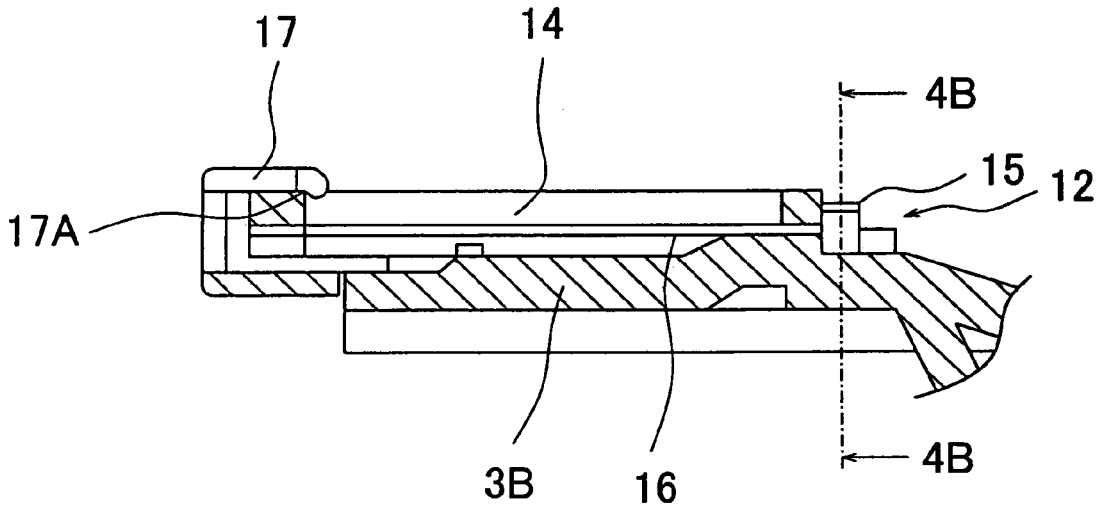
FIGS. 4A and 4B are diagrammatic sectional views of the paper separation mechanism.
Figure 4B:
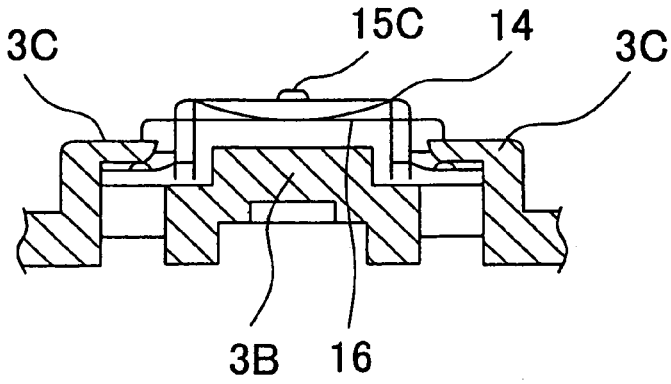
Figure 8:
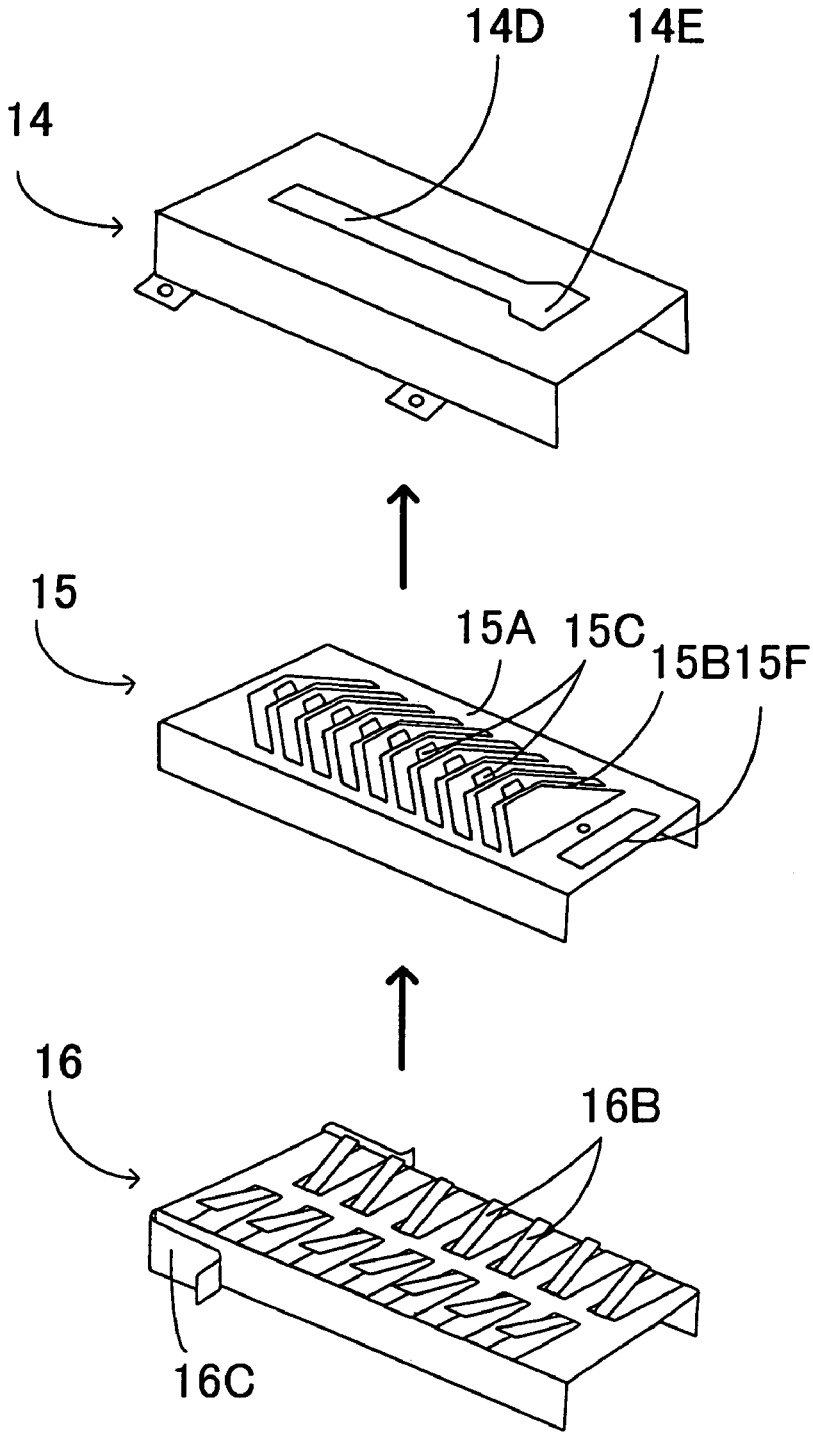
FIG. 8 is an exploded perspective view showing the structure of the paper separation mechanism.

The paper separation mechanism 12 will now be described with reference to FIG. 3, FIG. 4 and FIG. 8. FIGS. 3A and 3B are a plan view and a side view showing the structure of the paper separation mechanism 12. FIG. 4A is a sectional view of the paper separation mechanism 12 along line 4A—4A in FIG. 1 and FIG. 4B is a sectional view of the paper separation mechanism 12 along line 4B—4B in FIG. 4A. FIG. 8 is a perspective view showing the positional relationship of components constituting the paper separation mechanism 12. It is to be noted that only the approximate configuration of each component is shown by omitting the details in FIG. 8.

As shown in FIGS. 3, 4 and 8, the paper separation mechanism 12 comprises a paper separation unit 15, a holder unit 14 for holding the paper separation unit 15 and a separation unit retainer 16 for retaining the paper separation unit 15 from thereunder. The paper separation unit 15, the holder unit 14 and the separation unit retainer 16 are held unitedly by, for example, fittedly inserting a holder member 17 of synthetic resin (e.g. polyacetal) from one end of these united components.

Figure 5A:
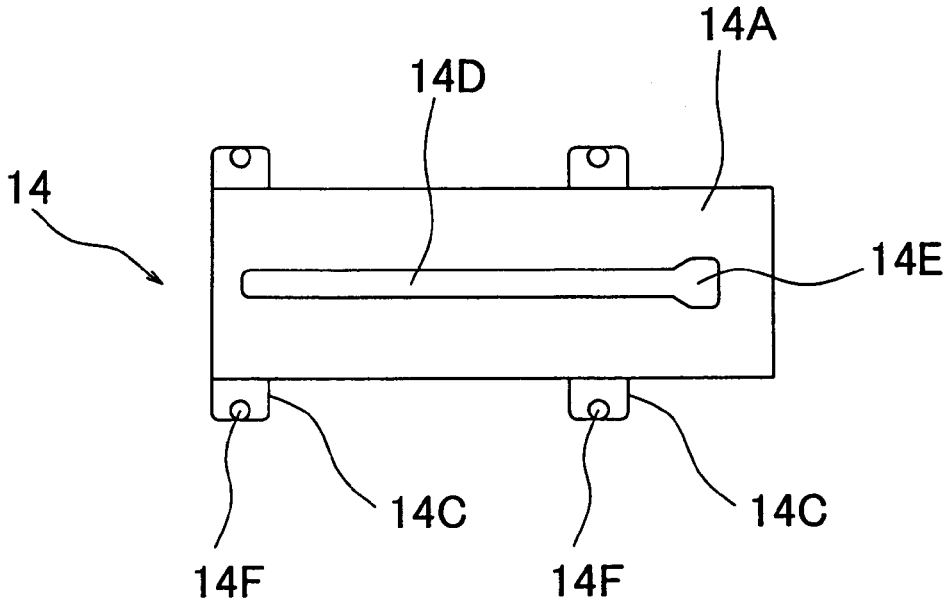
FIGS. 5A and 5B are explanatory views illustrating a holder unit.
Figure 5B:
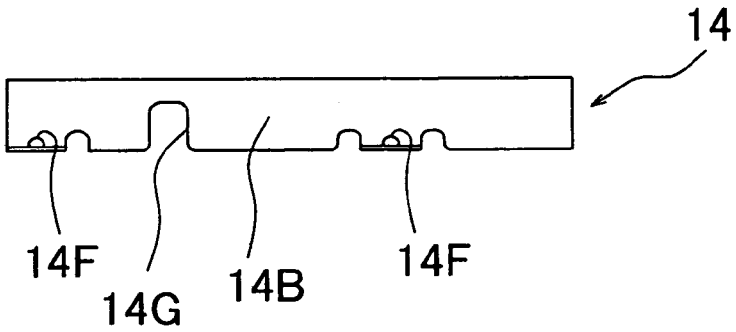
Figure 6A:
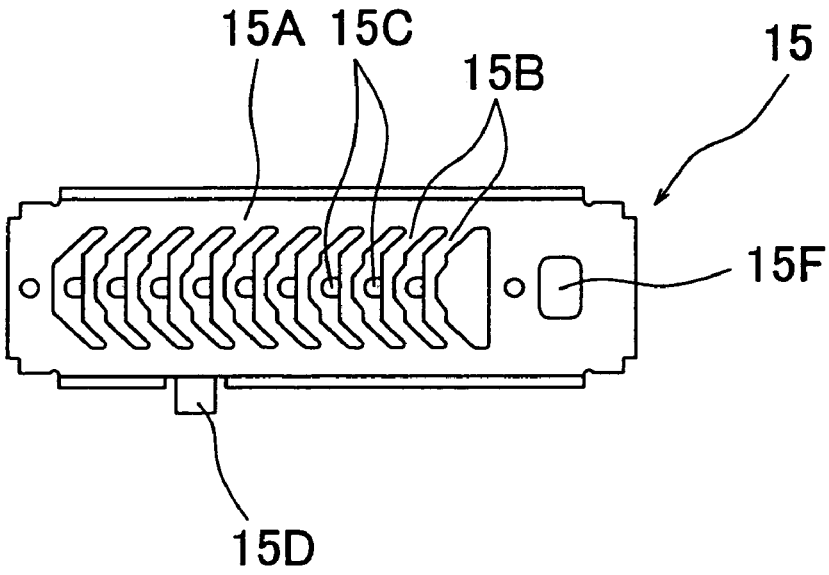
FIGS. 6A and 6B are explanatory views illustrating a paper separation unit.
Figure 6B:
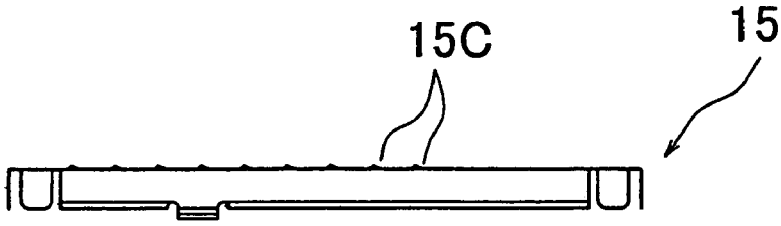
Figure 7A:
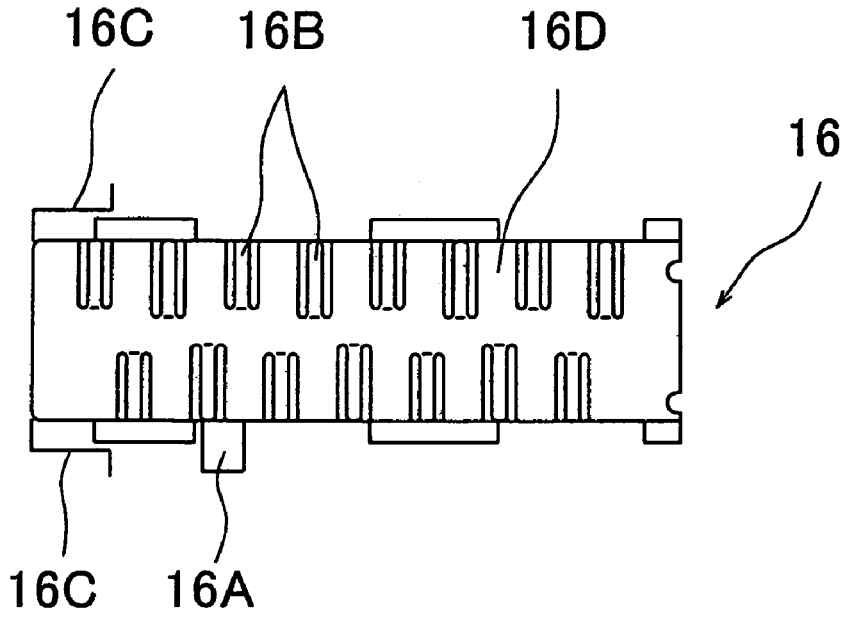
FIGS. 7A and 7B are explanatory views illustrating a separation unit retainer.
Figure 7B:
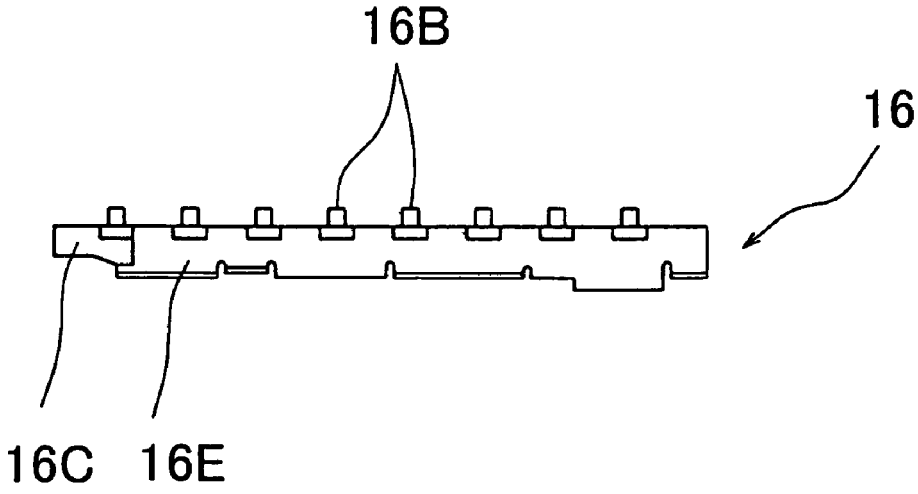

The respective components constituting the paper separation mechanism 12 will now be described. FIGS. 5A and 5B are a plan view and a side view of the holder unit 14, FIGS. 6A and 6B are a plan view and a side view of the paper separation unit 15, and FIGS. 7A and 7B are a plan view and a side view of the separation unit retainer 16.

As shown in FIGS. 5A and 5B, the holder unit 14 made of, for example, an SUS (stainless steel) plate is provided with a horizontal upper wall portion 14A, side wall portions 14B extending downward from both sides of the upper wall portion 14A and fixing portions 14C each formed by bending from each of the side wall portions 14B so as to extend horizontally. The holder unit 14 has a given length in the moving direction of the paper.

The upper wall portion 14A is provided with an elongated hole 14D formed along the moving direction of the paper. The elongated hole 14D is designed to allow projections 15C formed in the paper separation unit 15 to be exposed above the upper surface of the upper wall portion 14A.

One end (the right end in FIG. 5A) of the elongated hole 14D is provided with a positioning hole 14E, which engages with a positioning projection 17A formed in the upper wall of the holder member 17 (see FIG. 4A). The holder unit 14 and the holder member 17 are thereby fixed with a proper positioning.

Each fixing portion 14C of the holder unit 14 has a protrusion 14F formed to protrude upward. Each protrusion 14F is pressed against the reverse surface of a fixing piece 3C (see FIG. 4B) formed integrally with the main housing 2. Specifically, the lower end of the holder unit 14 abuts a step-like portion of a fixing unit 3B, while each protrusion 14F is pressed against the reverse surface of the fixing piece 3C by the resilience of the fixing portion 14C, with the result that the holder unit 14 is fixed on the bottom wall 3.

One of the side wall portions 14B of the holder unit 14 is provided with an engaging slot 14G opening downward, as shown in FIG. 5B. The engaging slot 14G engages with an engaging projection 15D formed in the paper separation unit 15 and an engaging projection 16A formed in the separation unit retainer 16, so that the holder 14, the paper separation unit 15 and the separation unit retainer 16 may be mutually positioned.

The paper separation unit 15 formed by, for example, pressing a SUS plate comprises a plurality of projections 15C, a plurality of arm portions 15B each holding the each projection 15C from both sides thereof, and a base portion 15A supporting the respective arm portions 15B in a serial manner, as shown in FIGS. 6A and 6B. The end surface configuration of the paper separation unit 15 is approximately the same as the end surface configuration of the holder unit 14.

The paper separation unit 15 is to be placed under the holder unit 14, as shown in FIGS. 4A–4B and 8, and has a given length in the moving direction of the paper the same as the above-described holder unit 14.

The projections 15C are designed to bend from the respective arm portions 15B so as to make a 80–95 degree angle, for example, with respect to the paper stored in a slantingly stacked state in the paper feed apparatus 1. The length of the each projection 15C is determined such that a certain amount can project from through the elongated hole 14D of the holder unit 14. The amount of projection is around 0.1–0.4 mm, for example.

The lower end of the paper stored in a stacked state is abutted directly and supported by the respective projections 15C or the upper wall portion 14A of the holder unit 14. The each arm portion 15B holding the each projection 15C is flexible, and, therefore, can independently carry the load imposed by the paper.

The arm portion 15B is curved, which results in the lengthened arm portion 15B that allows the bending thereof to be changed in accordance with a small change of the load. In this case, the displacement of one projection 15C due to the bending of the arm portion 15B is designed not to affect the displacement of the adjacent projection 15C.

The separation unit retainer 16 is provided with multiple spring portions 16B and two engaging arms 16C, as shown in FIGS. 7A and 7B, and is arranged under the paper separation unit 15, as shown in FIG. 8. The spring portions 16B formed in an upper surface portion 16D of the separation unit retainer 16 are designed to abut the base portion 15A of the paper separation unit 15. Accordingly, the paper separation unit 15 is firmly retained by the separation unit retainer 16.

The engaging arms 16C formed at the ends of the side portions 16E of the separation unit retainer 16, as shown in FIGS. 3A–3B and 7A–7B, abut the side wall portions 14B of the holder unit 14 to position the holder unit 14, the paper separation unit 15 and the separation unit retainer 16 in an engaging manner.

The holder member 17 has, in the upper inner wall, the positioning projection 17A (see FIG. 4A) to engage with the positioning hole 14E formed at the end of the elongated hole 14D of the holder unit 14 and a positioning hole 15F formed in the paper separation unit 15. On the condition that the engaging projection 15D of the paper separation unit 15 and the engaging projection 16A of the separation unit retainer 16 engage with the engaging slot 14G, the positioning projection 17A engages with the positioning hole 14E of the holder unit 14 in a state in which the paper separation unit 15, the holder unit 14 and the separation unit retainer 16 are united. As a result, the holder member 17 holds the paper separation unit 15, the holder unit 14 and the separation unit retainer 16 unitedly.

The center of the paper separation unit 15 arranged in the paper separation mechanism 12 constituted as above and the center of the paper feed roller 10 are a predetermined distance P away from each other along the width direction of the paper, as shown in FIG. 1. The distance P is determined based on the common knowledge that a too long distance tends to cause a plurality of sheets of paper to be fed simultaneously, while a too short distance tends to cause an unsuccessful paper feed.

Figure 9:
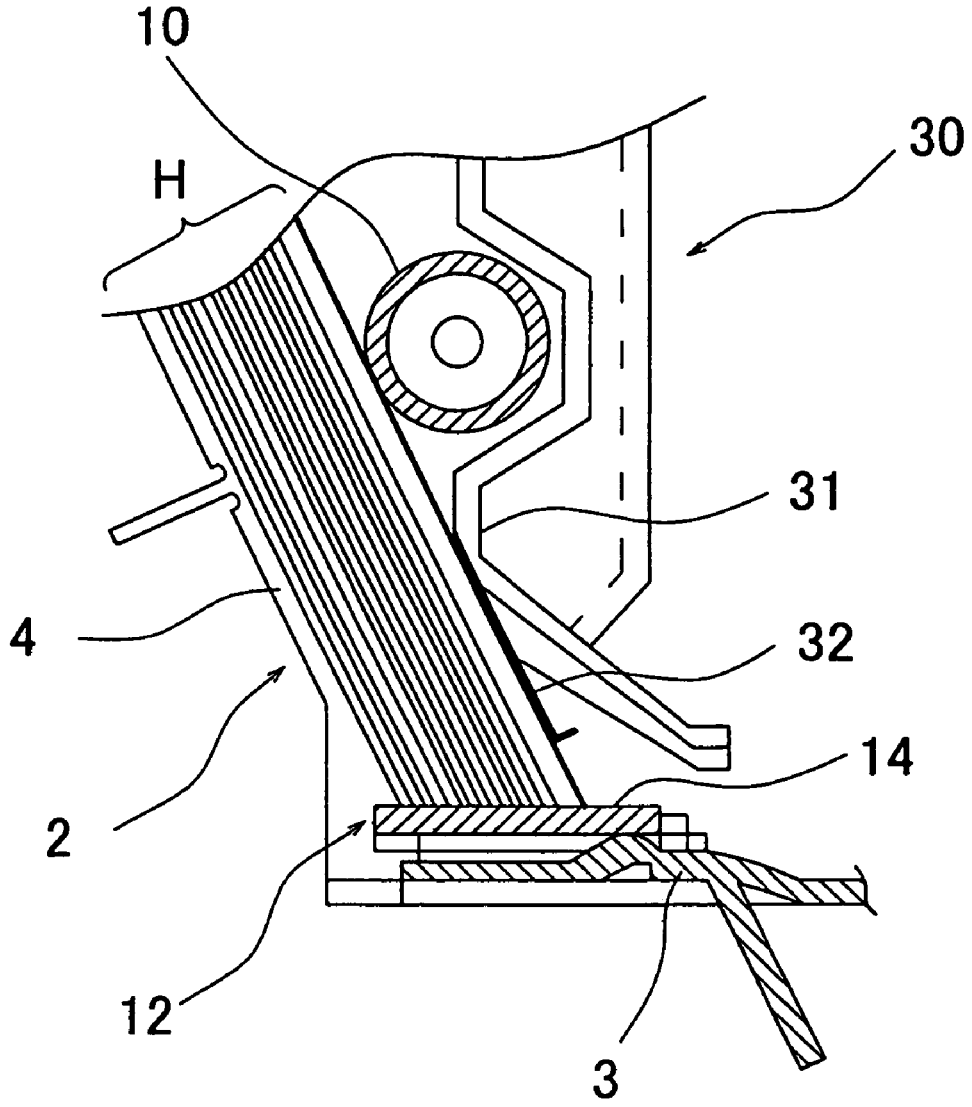
FIG. 9 is an explanatory view illustrating how to perform paper separation.

The paper feed mechanism will now be described with reference to FIG. 9. The paper feed mechanism comprises the paper feed roller 10, the cover 30 and a film 32, as shown in FIG. 9.

The paper feed roller 10 is rotationally driven by the driving of the train of gears within the roller support 9 based on the rotational driving of the drive mechanism 7, the roller gear 8 and the paper feed roller shaft 6.

The cover 30 is arranged at a position a predetermined distance away from the inclined wall 4 so as to store paper H, and is provided with a bent portion 31 facing the paper H. The film 32 having elasticity is attached to the cover 30 in the vicinity of the bent portion 31. The film 32 abuts the uppermost sheet of the paper H stored in a stacked state to control such that the lower end of the sheet of the paper H may be placed on the paper separation unit 15 in the paper separation mechanism 12.

According to the paper feed apparatus 1 constituted as above, paper feed is performed by the paper feed roller 10, which is rotationally driven, conveying the paper H stored in a stacked state separately sheet by sheet toward the lower direction of the main housing 2.

[Operation of the Paper Feed Apparatus]

Figure 10:
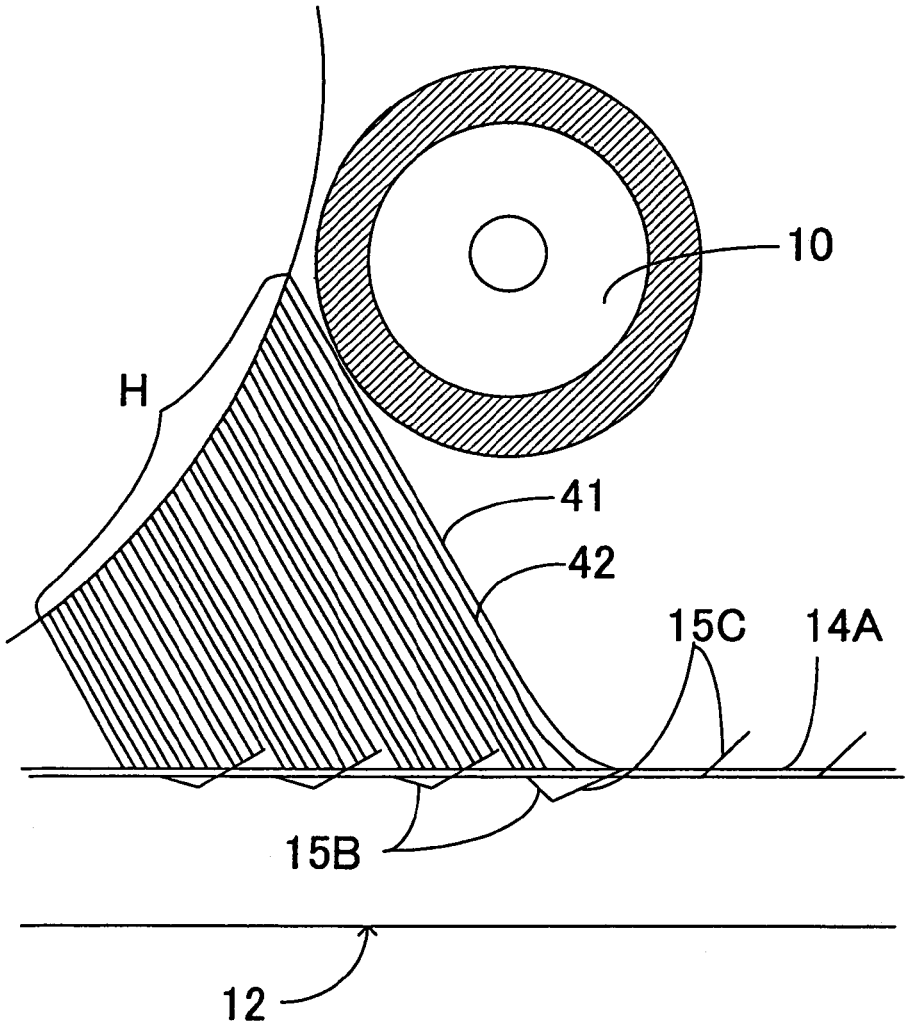
FIG. 10 is an enlarged view of the vicinity of the paper separation mechanism during separation of sheets of paper.

The operation of how separation of the paper is performed during paper feed will now be described with reference to FIG. 10, which is a sectional view around the paper separation mechanism 12.

The paper H stacked in the paper storage is supported by the holder unit 14 or the projections 15C of the paper separation unit 15. The arm portions 15B holding the projections 15C with the paper H thereon maintain balance with the load of the paper H by being bent to some extent.

An upper sheet of paper 41 located at the uppermost surface of the paper H is started to be fed in accordance with the rotation of the paper feed roller 10. Specifically, when the paper feed roller 10 starts to be rotated, the load imposed on the projection 15C becomes increased, resulting in an increased bending of the arm portions 15B. When the bending of the arm portion 15B reaches a certain amount, the uppermost sheet of paper 41 slides on the projection 15C to be fed.

If a lower sheet of paper 42 located at the second to the uppermost surface of the paper H moves along with the upper sheet of paper 41, the movement of the lower sheet of paper 42 is prevented because the bending of the arm portion 15B is cleared as soon as the front end of the upper sheet of paper 41 departs from the projection 15C. Even if the lower sheet of paper 42 passes the first projection 15C, the movement of the lower sheet of paper 42 may be more surely prevented by the second projection 15C that is not bent by the load of the paper H.

[Effects and Advantages of the Paper Feed Apparatus]

According to the paper feed apparatus 1 detailedly described in the embodiment, by holding the plurality of projections 15C by the arm portions 15B, respectively, the loads imposed on the respective projections 15C can be independently controlled by the respective arm portions 15B. Therefore, stable separation of the paper can be achieved without any complicated design or manufacturing of the projections 15C, and thus it is possible to prevent feeding of a plurality of sheets of the paper H simultaneously.

Also, in the present apparatus (the paper feed apparatus 1), the paper separation mechanism 12 configured separately from the bottom wall 3 is attached to the bottom wall 3. In other words, by configuring the plurality of projections 15C and the plurality of arm portions 15B independently from the bottom wall 3, detachment of the projections 15C and the arm portions 15B is facilitated, so that maintenance such as adjustment of the angle of the projections 15C and component replacement may be easily performed.

In the present apparatus (the paper feed apparatus 1), the paper storage 11 (i.e. the bottom wall 3 and the inclined wall 4) holds the plurality of sheets of paper H in an inclined state relative to the horizontal direction. When the paper H is held in the inclined state as above, the load imposed by the uppermost sheet of paper H on the second uppermost sheet of paper H is reduced, which facilitates separation of the paper H.

Furthermore, the paper separation unit 15 is integrally formed of metal. By integrally forming the paper separation unit 15, which may be constituted by a plurality of components, cost reduction can be achieved. Also, it is possible to prevent the respective projections 15C from coming off the respective arm portions 15B.

In addition, the arm portions 15B formed of metal are not easily fatigued in spite of the loads repeatedly imposed by the paper H. Furthermore, the respective projections 15C have an increased abrasion resistance, compared with the case of the paper separation unit 15 made of rubber, for example. This means that the abrasion of the projections 15C caused by the friction with the paper H can be reduced, and that the durability of the paper feed apparatus will be improved.

The respective projections 15C are arranged along the moving direction of the paper H to be fed. Accordingly, the respective projections 15C hold the paper H at positions where the loads by the paper H are appropriately maintained, so that stable separation of the paper H can be achieved.

The each projection 15C is held by the each arm portion 15B at the center of the arm portion 15B, while the arm portion 15B is supported by the base portion 15A at the both ends of the arm portion 15B. As a result, the projection 15C is prevented from tilting left or right relative to the paper feed direction, and thereby an increased stability of paper separation can be achieved.

The length of the arm portion 15B is lengthened by configuring the arm portion 15B with a combination of curved lines and/or linear lines. The arm portion 15B is designed to be bent in accordance with the load imposed on the corresponding projection 15C by the paper H. Accordingly, the longer the arm portion 15B becomes, the larger the amount of bending of the arm portion 15B may become. Therefore, the amount of bending of the arm portion 15B may be controlled in accordance with a small change of the load imposed by the paper H.

The paper separation unit 15 shown in FIG. 6 has the arm portions 15B extending rearward from the projections 15C relative to the paper feed direction. When the paper separation unit 15 like this is employed in the paper feed apparatus 1, as the load by the paper is increased, the angle of the projections 15C against the paper is increased, which enables the resistance during paper feed to be reduced.

The paper separation mechanism 12 is provided with the holder unit 14 having the elongated hole 14D formed along the moving direction of the paper H. The holder unit 14 is disposed over the paper separation unit 15, and the projections 15C in the paper separation unit 15 project upward a predetermined length from through the elongated hole 14D. As a result, it is possible to prevent the load of the paper from being imposed directly on the arm portions 15B, which may reduce the bending of the paper separation unit 15 and facilitate control of the bending amount of the arm portions 15B and control of the displacement amount of the projections 15C.

The paper separation mechanism 12 is also provided with the separation unit retainer 16 for retaining the base portion 15A from thereunder so as to be sandwiched between the separation unit retainer 16 and the holder unit 14. With the separation unit retainer 16, the base portion 15A is securely retained and the resilience of the paper separation unit 15 against the paper is increased, and thereby an increased stability of paper separation can be achieved.

In the paper separation mechanism 12, with respect to the friction coefficient of the respective surfaces of the paper separation unit 15 and the holder unit 14 which abut the paper, the friction coefficient between the paper separation unit 15 and the paper, and the friction coefficient between the holder unit 14 and the paper are set to be smaller than the friction coefficient between sheets of the paper (e.g. the friction coefficient between sheets of the paper $\mu \approx 0.5$, the friction coefficient between the SUS plate and the paper $\mu \approx 0.25$). As a result, the resistance during paper feed is reduced, which achieves further stable paper feed by optimumly setting the projection amount of the projections 15C and the abutting angle between the projection 15C and the paper.

[Modified Forms of Paper Feed Apparatus]

To prevent feeding of a plurality of sheets of paper simultaneously and secure sheet-by-sheet paper feed, paper separation units as described below may be employed other than the paper separation unit 15 shown in FIGS. 6A–6B.

Figure 11A:
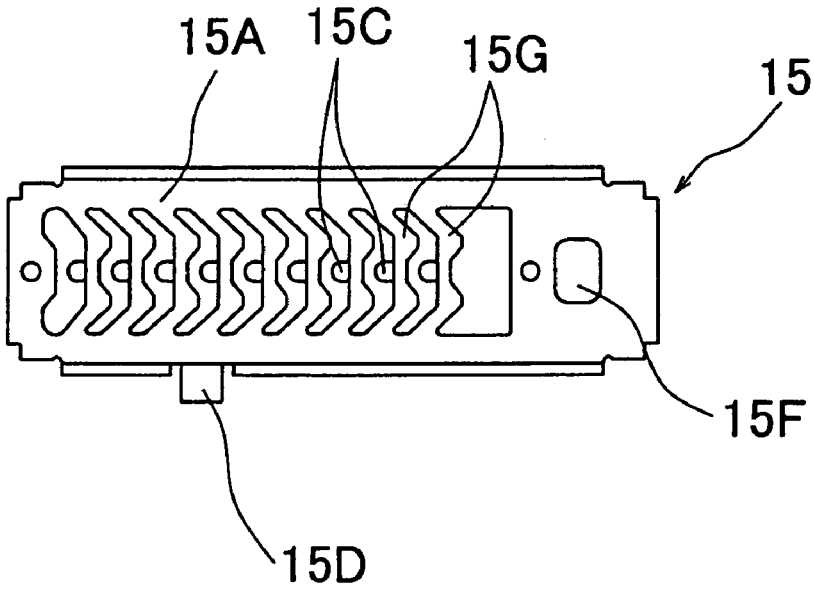
FIGS. 11A and 11B are explanatory views illustrating a paper separation unit according to another embodiment (having an arm portion with a different configuration)
Figure 11B:
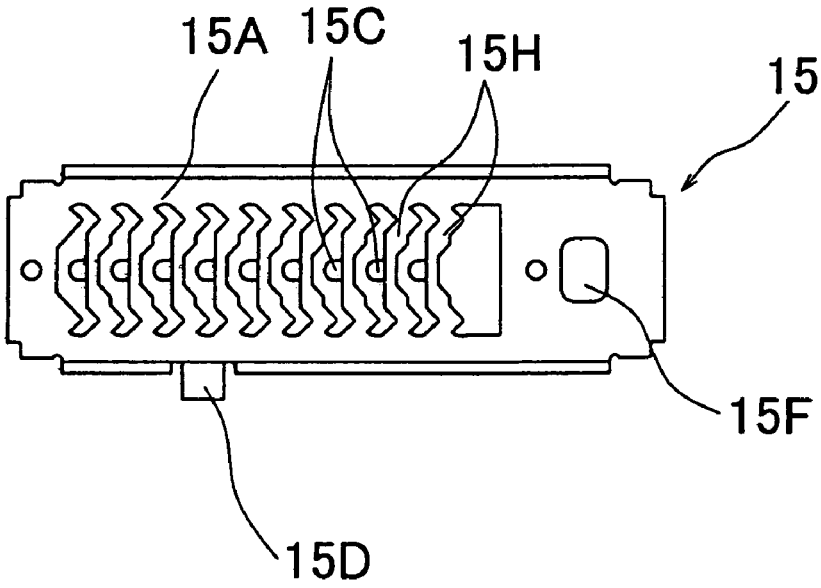

The paper separation unit 15 shown in FIG. 11A has arm portions 15G extending frontward from the projections 15C relative to the paper feed direction. The paper separation unit 15 shown in FIG. 11B has arm portions 15H bending a plurality of times. The paper separation unit 15 shown in FIGS. 6A–6B and the paper separation units 15 shown in FIG. 11A and FIG. 11B have the same structure except for the configuration of the arm portions. As described above, the arm portion may be configured in any form, as long as the each projection 15C may be independently displaced in accordance with the load imposed by the paper. An important point of the present invention is that the respective projections 15C are capable of being displaced in an independent manner instead of an integrated manner.

Figure 12:
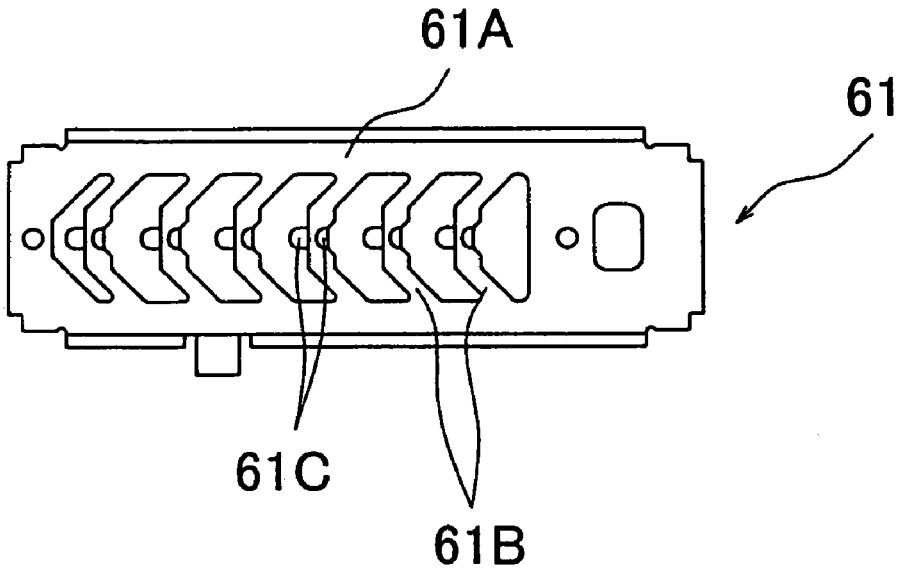
FIG. 12 is an explanatory view illustrating a paper separation unit according to yet another embodiment (having two projections arranged in each arm portion)

In a paper separation unit 61 shown in FIG. 12, the configurations of arm portions 61B and projections 61C are different from the configurations of those in the paper separation unit 15 shown in FIGS. 6A–6B. Specifically, each arm portion 61B held at the both ends thereof by a base portion 61A is provided with two projections 61C. As above, each projection 61C needs not to correspond to each arm portion 61B, but a plurality of projections 61C may be provided to each arm portion 61B.

Figure 13:
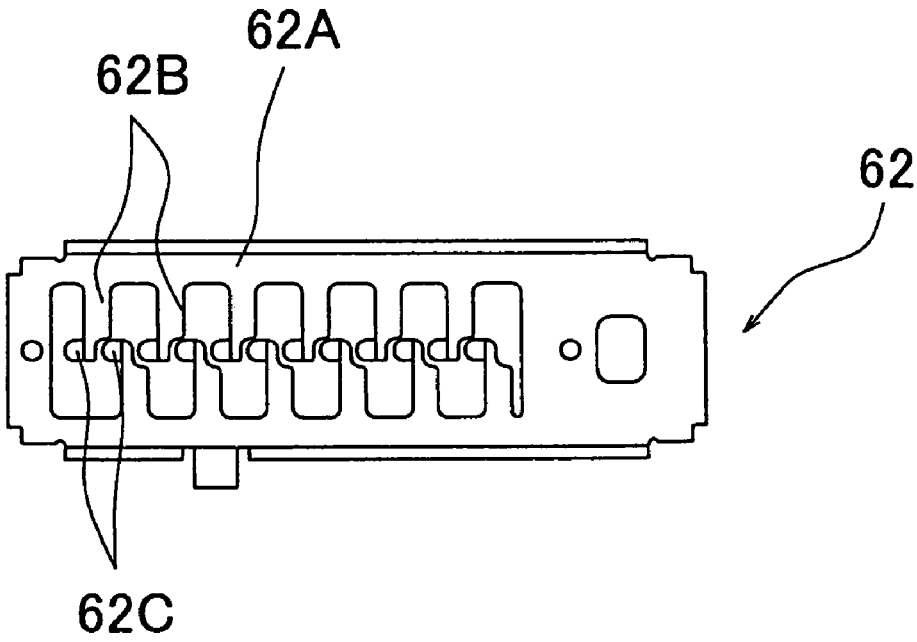
FIG. 13 is an explanatory view illustrating a paper separation unit according to a further embodiment (having cantilever arm portions)

Also, the arm portion needs not to be held at the both ends thereof. As in the paper separation unit 62 shown in FIG. 13, each arm portion 62B may be held by a base portion 62A in a cantilever manner. In this case, each projection 62C is integrally formed at the tip end of each arm portion 62B.

Figure 14A:
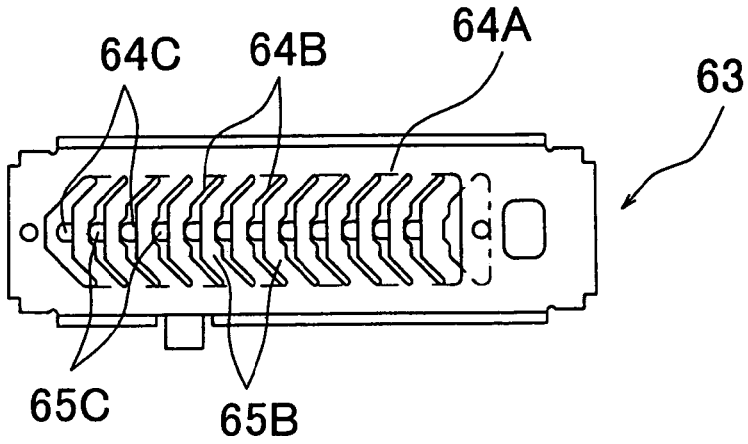
FIGS. 14A to 14C are explanatory views illustrating a paper separation unit according to another embodiment (having an upper paper separation plate and a lower paper separation plate, and an arm portion held at the both ends thereof)
Figure 14B:
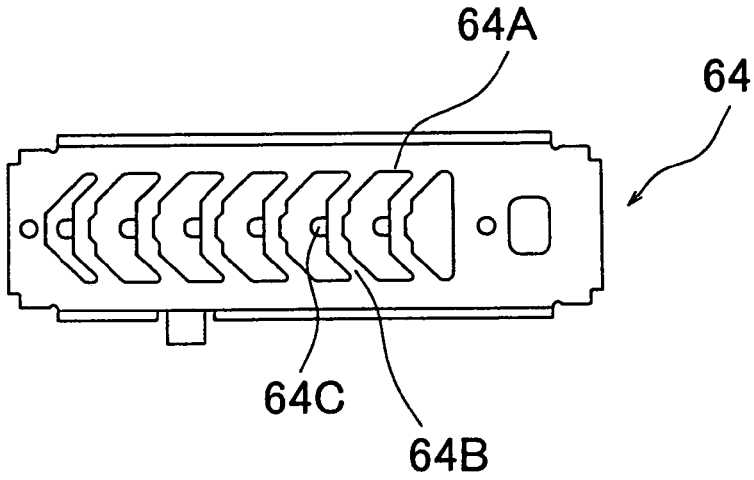
Figure 14C:
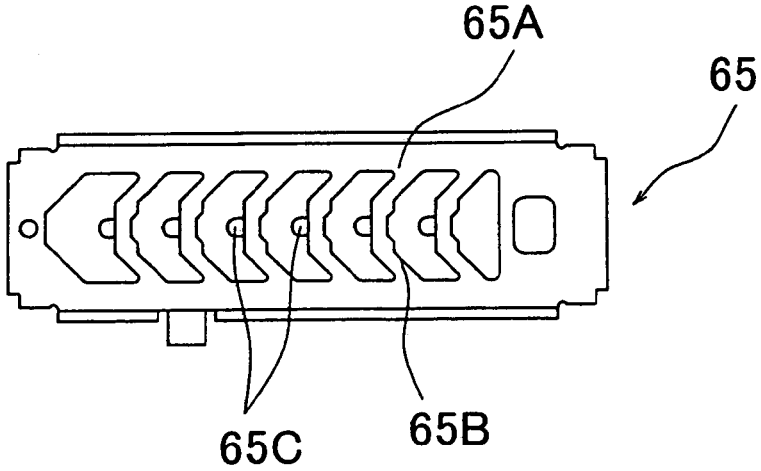
Figure 15A:
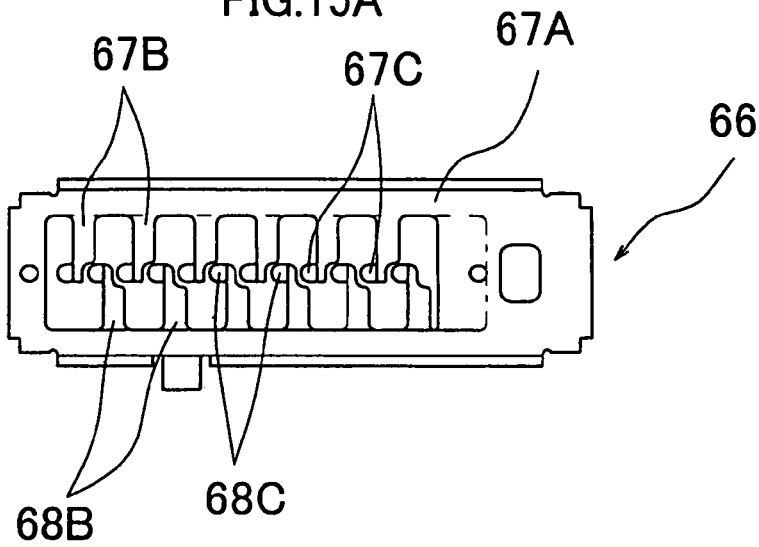
FIGS. 15A to 15C are explanatory views illustrating a paper separation unit according to a further embodiment (having an upper paper separation plate and a lower paper separation plate, and cantilever arm portions)
Figure 15B:
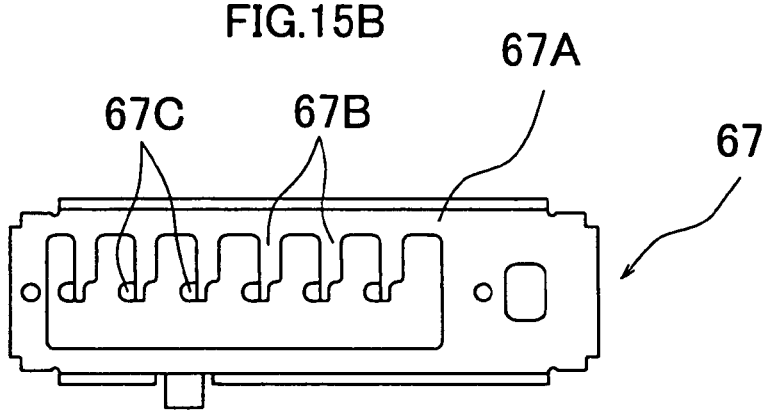
Figure 15C:
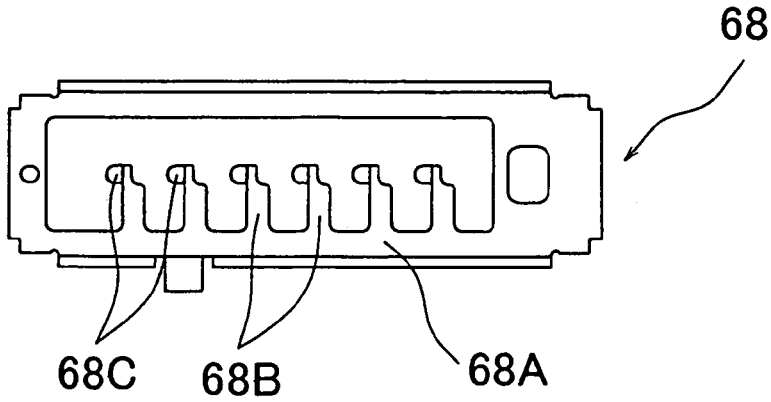
Figure 16A:
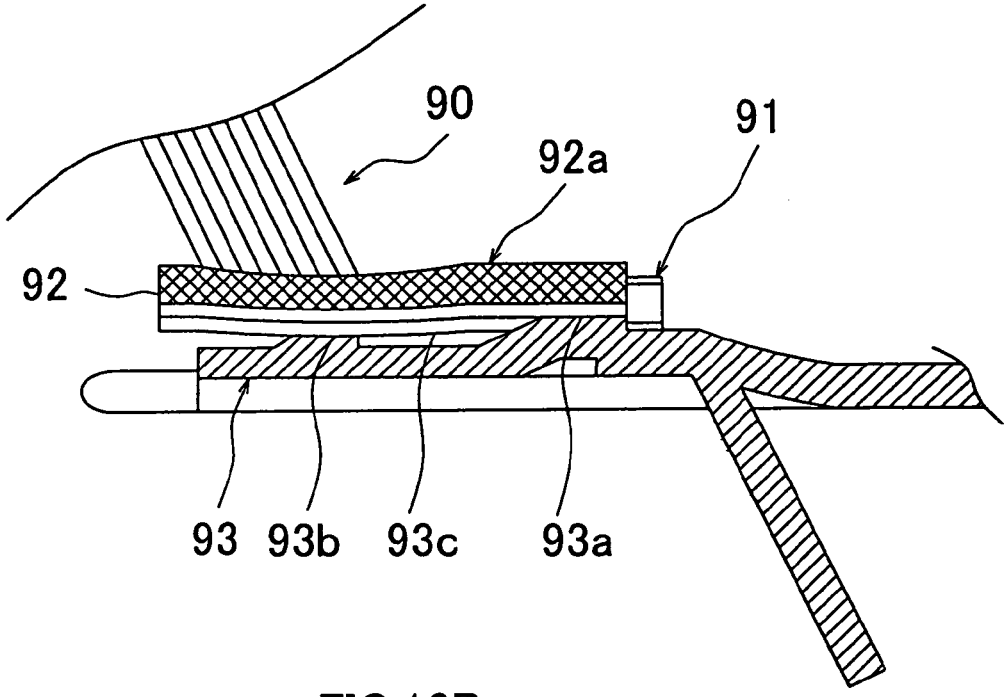
FIG.16A Related Art
FIGS. 16A and 16B are explanatory views illustrating how separation of paper is performed according to a prior art apparatus.
Figure 16B:
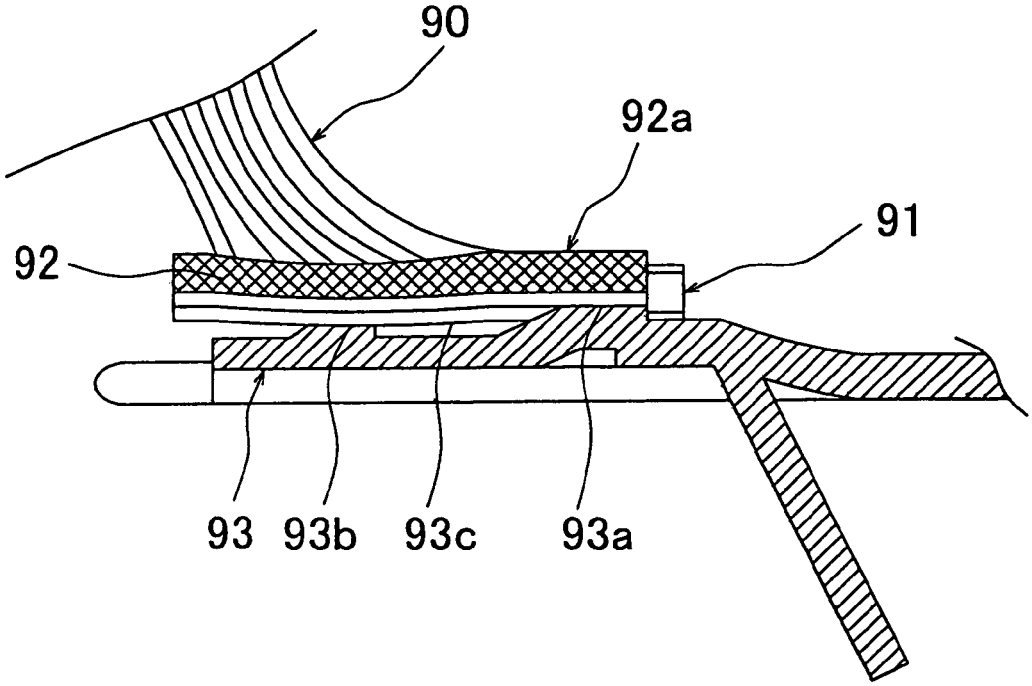
FIG.16B Related Art
Figure 17A:
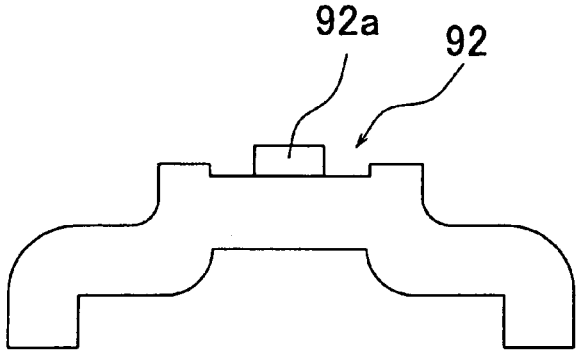
FIG.17A Related Art
FIGS. 17A to 17C are explanatory views illustrating a prior art paper separation unit.
Figure 17B:
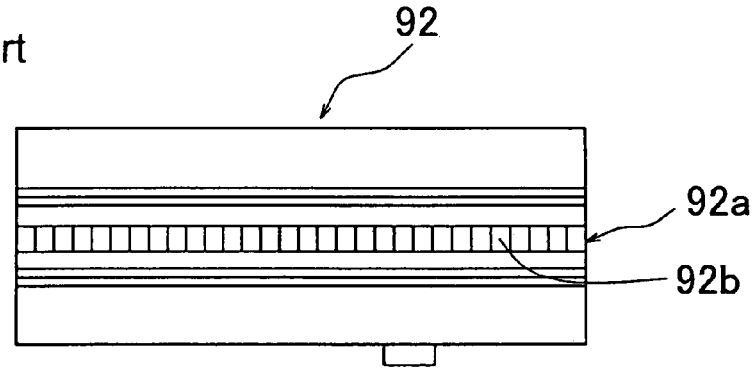
FIG.17B Related Art
Figure 17C:
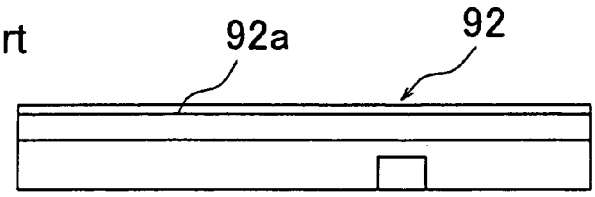
FIG.17C Related Art

The paper separation unit may also be constituted by combining two paper separation plates (i.e. an upper paper separation plate and a lower paper separation plate) as shown in FIGS. 14A–14C and in FIGS. 15A–15C.

In a paper separation unit 63 in FIGS. 14A–14C, the lower paper separation plate 65 in FIG. 14C having a base portion 65A, arm portions 65B and projections 65C in the same manner as in the above described paper separation unit is disposed under the upper paper separation plate 64 in FIG. 14B. The upper paper separation plate 64 is provided with a base portion 64A, arm portions 64B and projections 64C in the same manner as in the lower paper separation plate 65.

When the upper paper separation plate 64 is laid on the lower paper separation plate 65, the projections 64C of the upper paper separation plate 64 and the projections 65C of the lower paper separation plate 65 alternately project upward. The size of each projection is determined such that an identical height of all the projections can be obtained in a state in which the upper paper separation plate 64 is laid on the lower paper separation plate 65. Specifically, the height of the projection 65C is larger than the projection 64C by the thickness of the upper paper separation plate 64.

In a paper separation unit 66 in FIGS. 15A–15C, the lower paper separation plate 68 in FIG. 15C having a base portion 68A, arm portions 68B and projections 68C in the same manner as in the above described paper separation unit is disposed under the upper paper separation plate 67 in FIG. 15B. The upper paper separation plate 67 is provided with a base portion 67A, arm portions 67B and projections 67C in the same manner as in the lower paper separation plate 68.

When the upper paper separation plate 67 is laid on the lower paper separation plate 68, the projections 67C of the upper paper separation plate 67 and the projections 68C of the lower paper separation plate 68 alternately project upward. The size of each projection is determined such that an identical height of all the projections can be obtained in a state in which the upper paper separation plate 67 is laid on the lower paper separation plate 68. Also in this case, the height of the projection 68C is larger than the projection 67C by the thickness of the upper paper separation plate 67.

The paper separation unit 63 shown in FIGS. 14A–14C and the paper separation unit 66 shown in FIGS. 15A–15C have the same structure except that the arm portion is held at the both ends thereof (FIGS. 14A–14C) or is held in a cantilever manner (FIGS. 15A–15C).

In the paper separation units shown in FIGS. 14A–14C and in FIGS. 15A–15C, each of which is constituted by two paper separation plates, the distance between neighboring projections can be reduced. This results in reduction of the loads imposed by the paper on the respective projections, so that stable paper feed without feeding a plurality of sheets of paper simultaneously can be achieved. Also, by constituting the paper separation unit by two paper separation plates, the projections can be arranged with an optimum density, so that the stability of paper feed may be improved. In addition, reduction of the loads imposed by the paper on the respective projections may reduce damage on the paper caused by the friction between the paper and the projections.

While a single paper separation mechanism 12 is provided on the bottom wall 3 in the paper separation apparatus 1, two or more paper separation mechanisms 12 may be provided on the bottom wall 3, in order to achieve further secure paper separation. When a plurality of paper separation mechanisms 12 are provided in parallel, paper separation can be performed simultaneously by the plurality of paper separation mechanisms 12, which may facilitate further secure paper separation.

The paper separation mechanism 12, which is constituted as a component separate from the bottom wall 3 in the paper separation apparatus 1, may be constituted integrally with the bottom wall 3.

The paper storage 11 (i.e. the bottom wall 3 and the inclined wall 4), which holds a plurality of sheets of paper H in an inclined state in the paper separation apparatus 1, may hold a plurality of sheets of paper horizontally as long as the paper storage 11 and the paper separation mechanism 12 make an obtuse angle therebetween.

What is claimed is:

1. A paper feed apparatus for use with a paper storage capable of storing a plurality of sheets of paper, a paper feed mechanism having a paper feed roller for separating the paper stored in the paper storage sheet by sheet and capable of feeding the separated paper to a given convey path, and an inclined surface provided in the given convey path such that the inclined surface makes an obtuse angle relative to the paper stored in the paper storage, the paper feed apparatus comprising:

a plurality of projections capable of engaging with ends of the plurality of sheets of paper and of projecting from the inclined surface; and a plurality of resilient arm portions that hold the respective projections at respective positions so as to project from a surface of the inclined surface, wherein the arm portions are aligned in at least one row along a conveying direction of the paper, wherein the inclined surface is provided with an elongated hole formed along the conveying direction of the paper, wherein the plurality of projections project from the inclined surface through the elongated hole.

2. The paper feed apparatus according to claim 1, wherein the arm portions are formed of metal.

3. The paper feed apparatus according to claim 1, wherein the projections are formed of a material having a high abrasion resistance.

4. The paper feed apparatus according to claim 1, wherein the plurality of projections are arranged along the conveying direction of the paper.

5. The paper feed apparatus according to claim 1, wherein the projections are formed integrally with the arm portions.

6. The paper feed apparatus according to claim 1, wherein each of the arm portions has a bent configuration.

7. The paper feed apparatus according to claim 1, wherein each of the arm portions is held in a cantilever manner.

8. The paper feed apparatus according to claim 1, wherein each of the arm portions is held at the both ends thereof.

9. The paper feed apparatus according to claim 1, wherein each of the arm portions holds at least two of the projections.

10. The paper feed apparatus according to claim 1, wherein each of the arm portions holds each of the projections independently.

11. The paper feed apparatus according to claim 1, wherein the paper storage is capable of holding the plurality of sheets of paper in an inclined state relative to a horizontal plane.

12. A paper separation mechanism for use in a paper feed apparatus provided with a paper feed roller for separating a plurality of stacked sheets of paper and feeding the paper sheet by sheet, the paper separation mechanism comprising:

a paper separation unit including:

a plurality of projections capable of engaging with ends of a plurality of stacked sheets of paper in the paper feed direction;

a plurality of resilient arm portions that hold the respective projections at respective positions so as to engage with the ends of the paper; and a base portion that holds the resilient arm portions, wherein the arm portions are aligned in at least one row along a conveying direction of the paper; and a holder unit having an elongated hole formed along the paper feed direction of the paper, wherein the projections of the paper separation unit project upward at a predetermined length through the elongated hole of the holder unit.

13. The paper separation mechanism according to claim 12, wherein at least the surface of the holder unit, which abuts the ends of the sheets of paper, is made of a material having a friction coefficient with the paper lower than a friction coefficient between the sheets of paper.

14. The paper separation mechanism according to claim 12, further comprising a separation unit retainer for retaining the base portion from thereunder and sandwiching the base portion between the separation unit retainer and the holder unit.

15. The paper separation mechanism according to claim 12, wherein each of the projections is held at the center of the arm portion, and wherein the arm portion is held at the both ends thereof by the base portion.

16. The paper separation mechanism according to claim 12, wherein each of the arm portions is held in a cantilever manner by the base portion.

17. The paper separation mechanism according to claim 12, wherein the paper separation unit comprises a plurality of paper separation plates, each of the paper separation plates including the base portion that holds the arm portions, and the paper separation plates being stacked such that the arm portions and the projections alternate with each other, respectively.

18. The paper separation mechanism according to claim 12, wherein a single one of the arm portions holds at least two of the projections.

19. The paper separation mechanism according to claim 12, wherein each of the arm portions independently holds the each projection.

20. The paper separation mechanism according to claim 12, wherein the paper separation unit is made of metal.

21. A paper feed apparatus comprising:

a paper storage capable of storing a plurality of sheets of paper;

a paper feed mechanism having a paper feed roller for separating the paper stored in the paper storage sheet by sheet and capable of feeding the separated paper to a given convey path; and an inclined surface provided in the given convey path such that the inclined surface makes an obtuse angle relative to the paper stored in the paper storage, wherein the paper separation mechanism according to claim 12 is provided on the inclined surface.

22. The paper feed apparatus according to claim 21, wherein the paper storage holds the plurality of sheets of paper in an inclined state relative to a horizontal plane.

23. The paper feed apparatus according to claim 21, wherein two or more of the paper separation mechanisms are provided on the inclined surface.

24. The paper feed apparatus according to claim 1, wherein the projections make a 80–95 degree angle with respect to the paper.

25. The paper feed apparatus according to claim 1, wherein the projections are designed to bend from the respective arm portions.

26. The paper separation mechanism according to claim 12, wherein the projections make a 80–95 degree angle with respect to the paper.

27. The paper separation mechanism according to claim 12, wherein the projections are designed to bend from the respective arm portions.

* * * * *